US006373390B1

(12) United States Patent
Hogan et al.

(10) Patent No.: US 6,373,390 B1
(45) Date of Patent: Apr. 16, 2002

(54) ELECTRONIC ARTICLE SURVEILLANCE TAG HAVING ARCUATE CHANNEL

(75) Inventors: Dennis L. Hogan, Lighthouse Point; Thang Tat Nguyen, Boca Raton; Sergio M. Perez, Boynton Beach; Andrew Proulx, Lake Worth, all of FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 0 days.

(21) Appl. No.: 09/634,236

(22) Filed: Aug. 8, 2000

(51) Int. Cl.[7] ..... G08B 13/14

(52) U.S. Cl. ..... 340/572.8; 340/572.9; 340/572.1; 340/568.1; 340/825.54

(58) Field of Search ..... 340/572.8, 572.9, 340/572.1, 568.1, 825.54

(56) References Cited

U.S. PATENT DOCUMENTS

| | | | | |
|---|---|---|---|---|
| 3,942,829 A | | 3/1976 | Humble et al. | 292/316 |
| 4,356,477 A | | 10/1982 | Vanderbult | 340/572 |
| 4,429,302 A | | 1/1984 | Vanderbult | 340/572 |
| 4,510,489 A | | 4/1985 | Anderson et al. | 340/572 |
| 4,510,490 A | | 4/1985 | Anderson et al. | 340/572 |
| 4,686,516 A | | 8/1987 | Humphrey | 340/572 |
| 4,797,658 A | | 1/1989 | Humphrey | 340/551 |
| 5,031,756 A | | 7/1991 | Buzzard et al. | 206/1.5 |
| 5,426,419 A | | 6/1995 | Nguyen et al. | 340/572 |
| 5,535,606 A | | 7/1996 | Nguyen et al. | 70/57.1 |
| 5,671,623 A | | 9/1997 | Hsu | 70/375 |
| 5,942,978 A | * | 8/1999 | Shafer | 340/572.9 |
| 5,955,951 A | * | 9/1999 | Wischerop et al. | 340/572.8 |

FOREIGN PATENT DOCUMENTS

| | | |
|---|---|---|
| DE | 8813887 | 3/1990 |

* cited by examiner

*Primary Examiner*—Daniel J. Wu
*Assistant Examiner*—Tai T. Nguyen
(74) *Attorney, Agent, or Firm*—Rick F. Comoglio; Paul T. Kashimba

(57) ABSTRACT

An EAS tag in which the tag is held to an article by an attaching assembly a part of which is releasably prevented from being withdrawn from the body of the tag. The tag body is provided with an arcuate channel through which an arcuate detacher probe can be guided for releasing the attaching assembly part. A spring clamp provides the releasable preventing function and includes jaws specifically adapted to respond to in-plane torsional forces provided by the arcuate probe which is moved through the arcuate channel by rotation to reach the spring clamp. An abutment and spring gate mechanism is placed within the arcuate channel to prevent a relatively rigid wire formed into an arcuate shape from being used to release the attaching assembly part.

8 Claims, 14 Drawing Sheets

ELECTRONIC ARTICLE SURVEILLANCE TAG HAVING ARCUATE CHANNEL

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates to electronic article surveillance tags and associated detachers and, more particularly, to an electronic article surveillance (EAS) tag with an improved detaching mechanism.

2. Description of the Related Art

Electronic article surveillance systems are well known in the art and are used for inventory control and to prevent theft and similar unauthorized removal of articles from a controlled area. Typically, in such systems a system transmitter and a system receiver are used to establish a surveillance zone, which must be traversed by any articles being removed from the controlled area.

An EAS tag is affixed to each article and includes a marker or sensor adapted to interact with a signal being transmitted by the system transmitter into the surveillance zone. This interaction causes a further signal to be established in the surveillance zone which further signal is received by the system receiver. Accordingly, upon movement of a tagged article through the surveillance zone, a signal will be received by the system receiver, identifying the unauthorized presence of the tagged article in the zone.

Certain types of EAS tags have been designed to be reusable and, thus, include releasable attachment devices for affixing the tags to the articles. Such attachment devices are further designed to be releasable by authorized personnel only so that unauthorized removal of a tag from its article is avoided. To this end, many attachment devices are made releasable only through the use of an associated special tool or detaching mechanism.

An EAS tag employing an attachment device and an associated detacher is described in U.S. Pat. No. 3,942,829, entitled REUSABLE SECURITY TAG, issued to Humble, et al. on Mar. 9, 1976 and assigned to same assignee hereof. The EAS tag of the '829 patent includes a tag body and an attachment device in the form of a tack assembly. The tack assembly includes an enlarged head and a tack body having a pointed end, which serves to pierce through an article and to be receivable in and clamped to the tag body. This secures the article and tag together.

In the tag of the '829 patent, the tack is clamped to the tag body using a spring clamp formed as a clutch lock with spreadable jaws. Once the article is pierced, the pointed tack end is received in the tag body and is secured between the jaws of the clutch lock. This locks the tack and the tag body forming the EAS tag to the article so that the tag and article cannot be readily separated from each other.

In order for authorized personnel to be able to release the tack from the clutch lock and, therefore, the tag from the article, the '829 patent utilizes a detacher mechanism which is adapted to grip the tag body and apply a bending force thereto. This force is sufficient to deform the clutch lock so that the jaws of the clutch lock are spread apart, thereby releasing the tack. The tack can then be removed from the tag body so that the article and tag become separated from one another.

To permit the bending of the tag body sufficiently to deform the clutch lock, the tag body of the '829 patent must be made of a flexible material. Typically, flexible plastic materials such as, for example, polypropylene, have been used. Such materials, however, are susceptible to being cut and damaged. This tends to be a disadvantage, since it increases the likelihood that the locking feature of the tag can be separated from the EAS sensor part of the tag or can be exposed and defeated.

Moreover, the tag body of the '829 patent must be relatively large in size in order to facilitate its flexing. This likewise tends to be a disadvantage, since use of large tags detracts from the aesthetic appearance of the articles to which the tags are attached.

Another type of EAS security device is known in which a variation of the spring clamp of the '829 patent has been incorporated into a so-called keeper for a compact disc. This type of device is disclosed in U.S. Pat. No. 5,031,756, entitled KEEPER FOR COMPACT DISC PACKAGE OR THE LIKE, issued to Buzzard, et al. on Jul. 16, 1991 and also assigned to same assignee hereof.

The keeper of the '756 patent comprises a rigid plastic frame. One side of the frame is provided with an enlarged section which houses a tack-like button assembly and a spring clamp as in the '829 patent. In this case, the spring clamp is used to lock the button assembly in a first position. In this position, the pointed end of the button assembly protrudes into the frame to pierce and hold to the frame a cardboard container containing a compact disc. As a result, unauthorized removal of the compact disc with the frame causes an EAS sensor also incorporated into the frame, to generate a detectable signal for alarming an EAS system.

In the keeper of the '756 patent, the enlarged section of the frame is provided with opposing linear slots, which lead to the region between the jaws of the spring clamp. By inserting ramped linear fingers into these slots, the fingers are guided into this region, causing the jaws to flex outward. This releases the button enabling it to be withdrawn from the cardboard container. The container and its housed compact disc can then be separated from the frame.

While the keeper of the '756 patent utilizes a spring clamp of the '829 patent type in a rigid frame, it also has certain drawbacks. One drawback is that the linear slots leading to the spring clamp permit in-line viewing and access to the clamp. This increases the susceptibility of the clamp to defeat, since linear objects can be inserted into the slots in an attempt to open the jaws. Another drawback is that the fingers of the detacher are required to be of high precision, since they must be received in the region between the spring clamp jaws. This increases the cost and complexity of the detacher.

U.S. Pat. No. 5,426,419, entitled SECURITY TAG HAVING ARCUATE CHANNEL AND DETACHER APPARATUS FOR SAME, issued to Nguyen, T. et al., on Jun. 20, 1995, and assigned to the same assignee hereof, the disclosure of which is incorporated herein by reference, discloses an EAS tag that does not suffer from the above disadvantages. The EAS tag has a hard tag body, which is adapted to be releasable from an article in an easy and simple manner by insertion of the arcuate probe of an associated detacher device into an arcuate channel of the tag to release a spring clamp mechanism. The spring clamp mechanism is a releasable locking mechanism that prevents removal of a tack assembly that is adapted for insertion through an article, which is captured when inserted into an opening in a portion of the tag body. The EAS tag of the '419 patent is more difficult to defeat that the above tags, but can be defeated by insertion of a segment of relatively rigid metal bent in an arcuate manner to simulate the arcuate probe of the associated detacher device, as fully described hereinbelow.

BRIEF SUMMARY OF THE INVENTION

In accordance with the principles of the present invention, an EAS tag is provided in which the tag includes a tag body and with an attaching assembly for attaching the tag body to an article. The attaching assembly includes a part, which is receivable in the tag body and the tag body is provided with a preventing mechanism for releasably preventing withdrawal of the attaching assembly part. Channel defining structure within the tag body defines an arcuate channel. This channel leads to the preventing mechanism and permits an arcuate probe to be guided to such mechanism for releasing same. Release of the preventing mechanism permits withdrawal of attaching assembly part thereby separating the attaching assembly and article from the tag body. An abutment mechanism within the arcuate channel prevents the insertion of a relatively rigid wire into the arcuate channel far enough to release the preventing mechanism, the wire is formed substantially in the arcuate shape of the arcuate probe.

In the embodiment of the invention to be disclosed hereinafter, the attaching assembly includes a tack having a head and a tack body, the latter being the part of attaching mechanism receivable in the tag body through a first opening. The preventing mechanism includes a receiving and clutching mechanism, which receives and clutches the tack body, thereby preventing withdrawal of the tack body from the tag body. A release part of the receiving and clutching mechanism when engaged causes the receiving and clutching mechanism to release, thereby allowing withdrawal of the tack body. A second opening in the tag body leads to the arcuate channel which, in turn, leads to the release part of the receiving and clutching mechanism to allow the arcuate probe to engage same to effect the release.

In another aspect of the invention the abutment mechanism is a substantially planar rigid member with a vertical and horizontal opening forming a substantially "L" shaped opening to receive a corresponding "L" shape of the arcuate probe, the rigid member is positionable substantially perpendicular in the arcuate channel, the vertical opening is sized and positioned to allow a vertical member of the "L" shape of the arcuate probe to closely pass through when the arcuate probe is inserted into the arcuate channel to release the preventing mechanism.

The abutment mechanism can include a spring gate assembly for preventing insertion of the formed wire, the spring gate assembly can include a catch for catching the formed wire and preventing further insertion of the wire into the arcuate channel. The catch is disposed on one end of a spring member, the spring member is attachable to the EAS tag body and biases the catch against a wall of the arcuate channel and in front of the vertical opening in the rigid member. A horizontal member of the "L" shaped arcuate probe pushes against the bias of the spring member upon insertion of the arcuate probe in the arcuate channel wherein the catch is pushed away from the vertical opening in the rigid member allowing the arcuate probe to closely pass therethrough. The catch can be a bent portion of the end of the spring member.

BRIEF DESCRIPTION OF THE DRAWINGS

The above and other features and aspects of the present invention will become more apparent upon reading the following detailed description in conjunction with the accompanying drawings, in which.

DETAILED DESCRIPTION OF THE INVENTION

Figure 1:
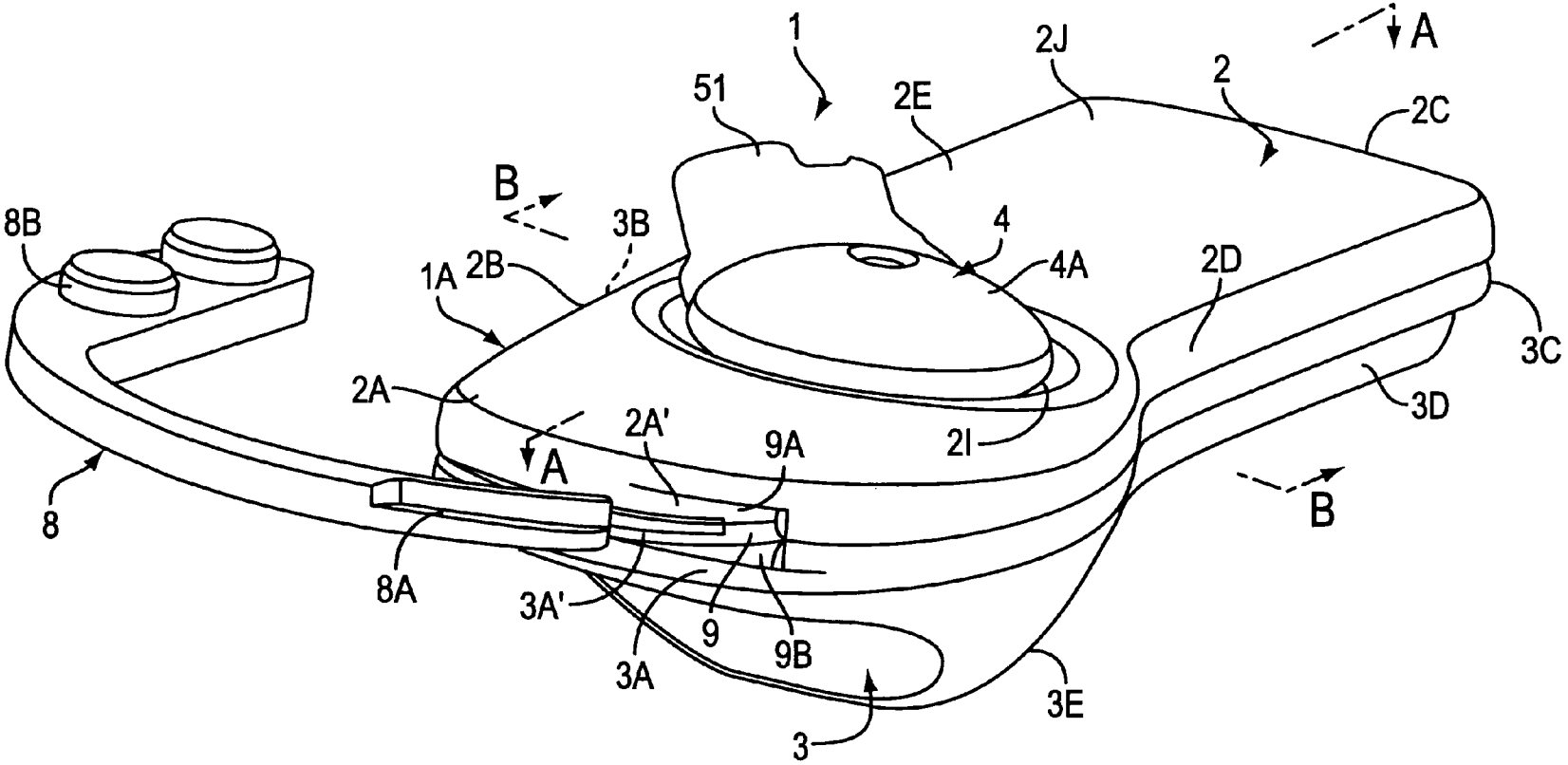
FIG. 1 (PRIOR ART)
FIG. 1 shows a prior art EAS tag and associated detacher probe in accordance with the principles of the present invention.

FIGS. 1–7 show various views of an EAS tag 1 in accordance with the principles of the invention as disclosed in U.S. Pat. No. 5,426,419, which has been incorporated herein by reference, a portion of the description of which follows herein. The description of the present invention, an improvement to EAS tag 1, is fully described thereafter. As shown in FIG. 1, the tag 1 includes an upper housing 2 having side walls 2A, 2B, 2C and 2D which are joined by a top wall 2E. The tag 1 also includes a lower housing 3 having side walls 3A, 3B, 3C and 3D which are joined by a bottom wall 3E. The upper and lower housings 2 and 3 are joined or mated along corresponding or associated side wall pairs (2A, 3A), (2B, 3B), (2C, 3C) and (2D, 3D) to form a closed tag body 1A.

The housings 2 and 3 are preferably made of a hard or rigid material. A usable rigid or hard material might be a hard plastic such as, for example, an injection molded ABS plastic. If a plastic is used, the mating side walls of the housings can be joined by an ultrasonic weld 1B or like joining mechanism.

Figure 2:
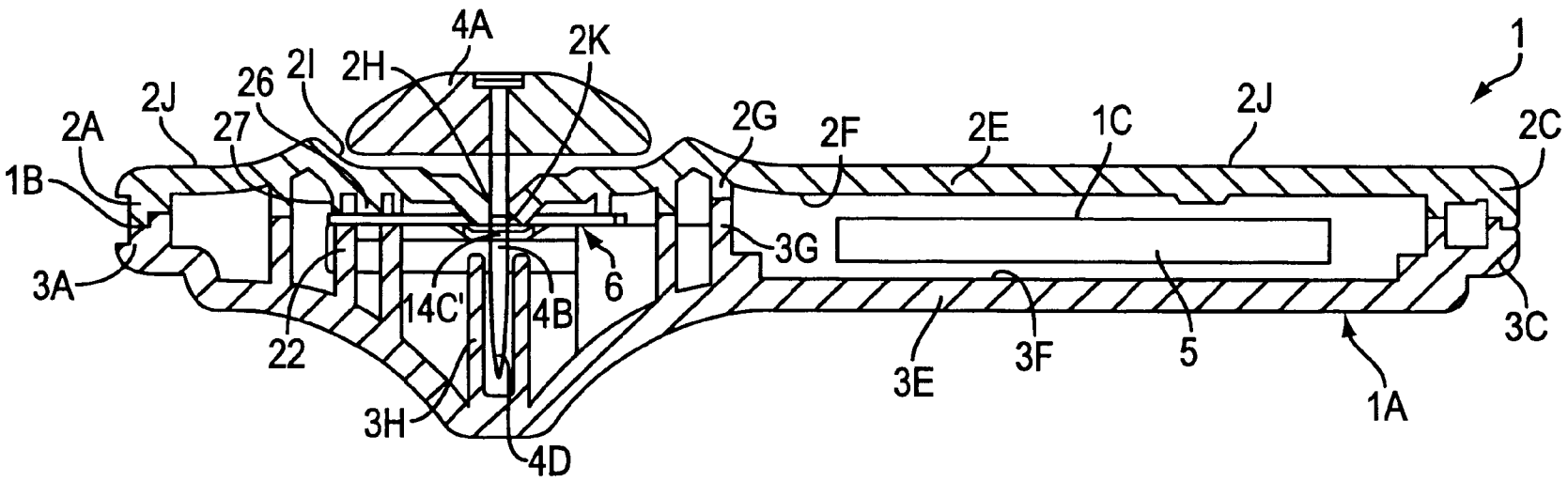
FIG. 2 (PRIOR ART)
FIG. 2 shows a cross-section of the EAS tag of FIG. 1 taken along the line A—A in FIG. 1.
Figure 6A:
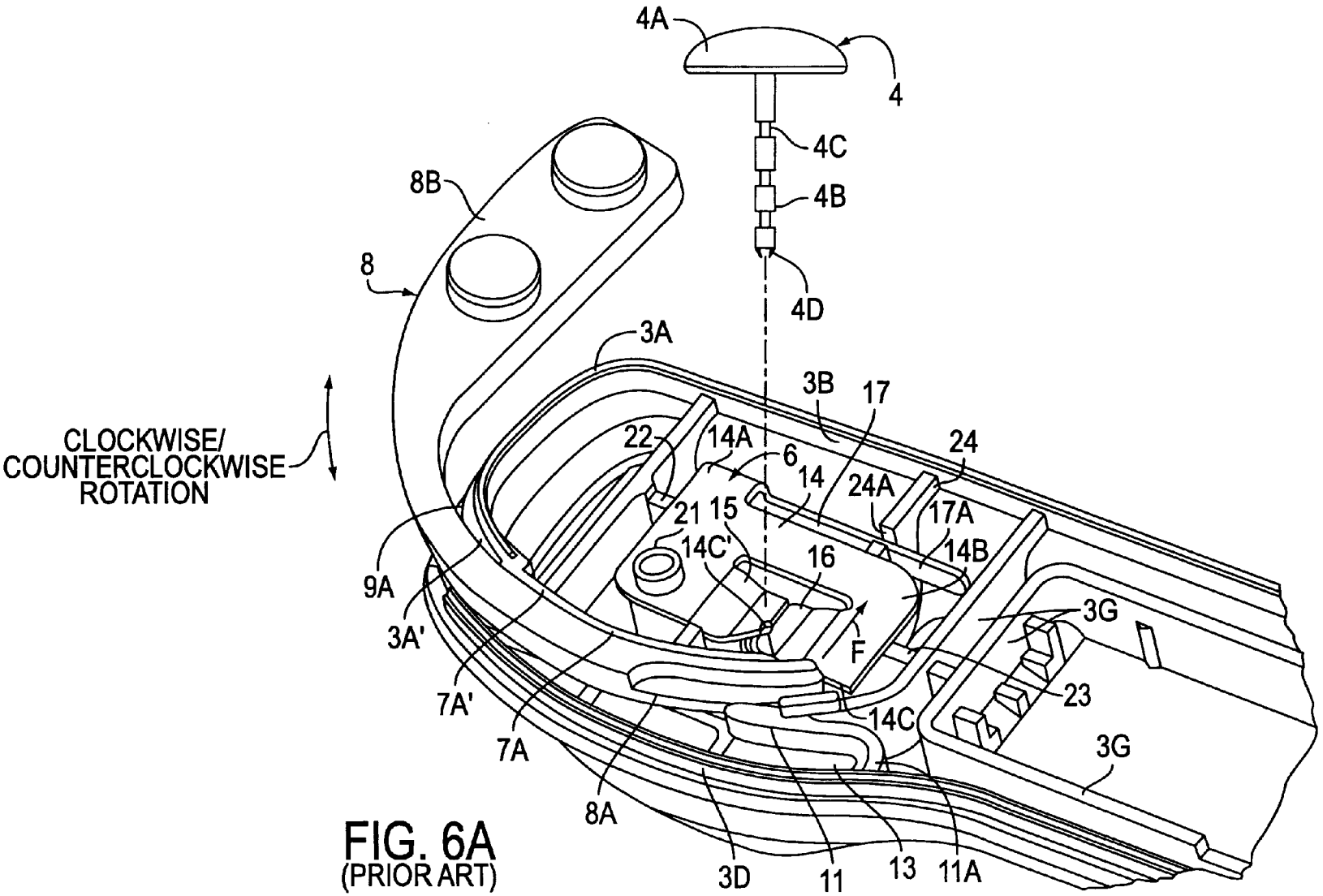
FIG. 6A (PRIOR ART)
FIGS. 6A and 6B show partial views of the interior of the lower housing of the EAS tag of FIG. 1 with the probe inserted in and withdrawn from the arcuate channel of the tag, respectively.

The tag 1 further includes a tack assembly 4 shown as having an enlarged tack head 4A and an elongated tack body 4B provided with slots or grooves 4C and a pointed forward end 4D (see, FIGS. 1, 2 and 6A). The tack assembly 4 is used to attach the tag body 1A to an article 51, which is to be protected by the EAS tag 1.

Figure 3:
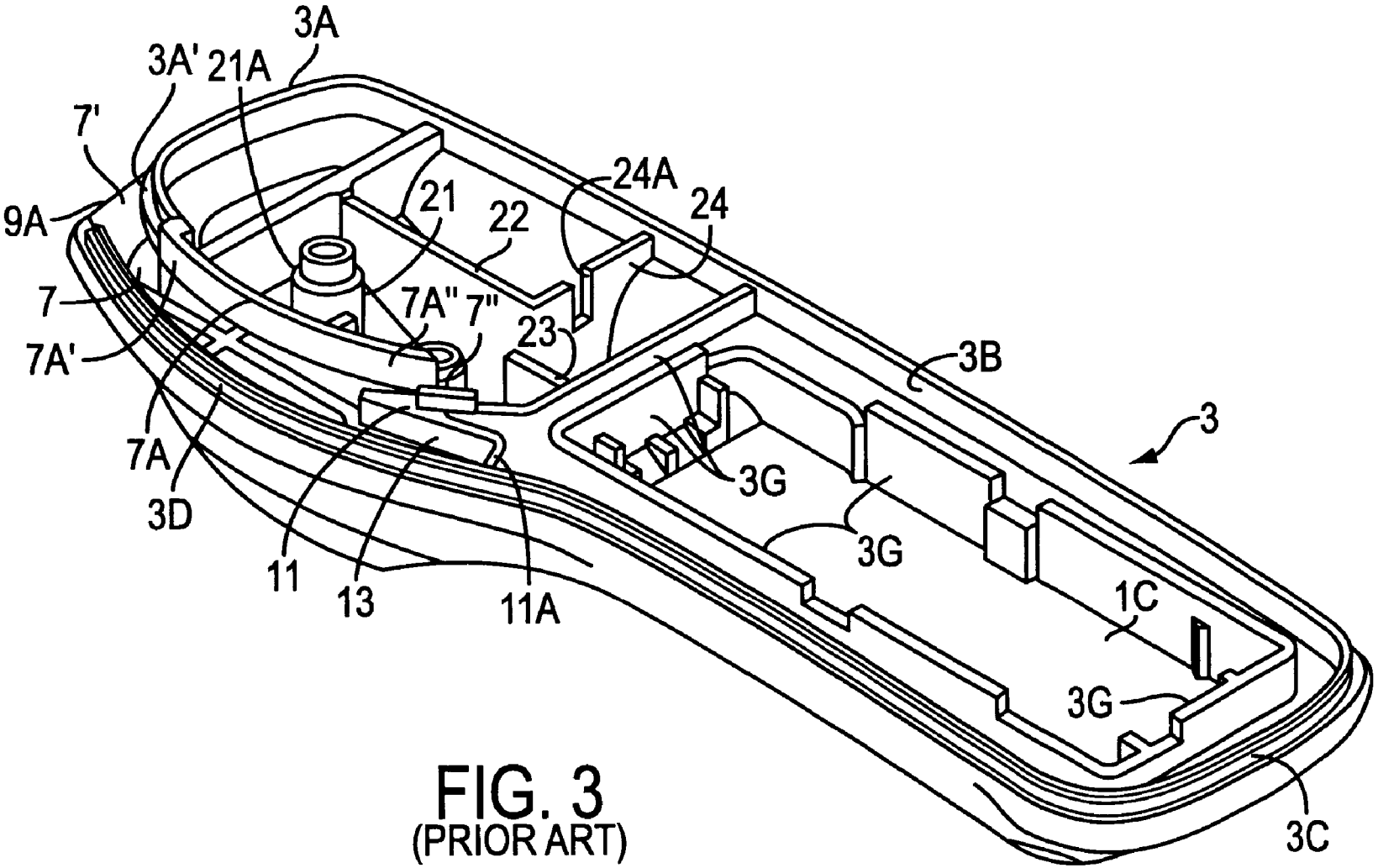
FIG. 3 (PRIOR ART)
FIG. 3 shows a view of the interior of the lower housing of the EAS tag of FIG. 1.
Figure 4A:
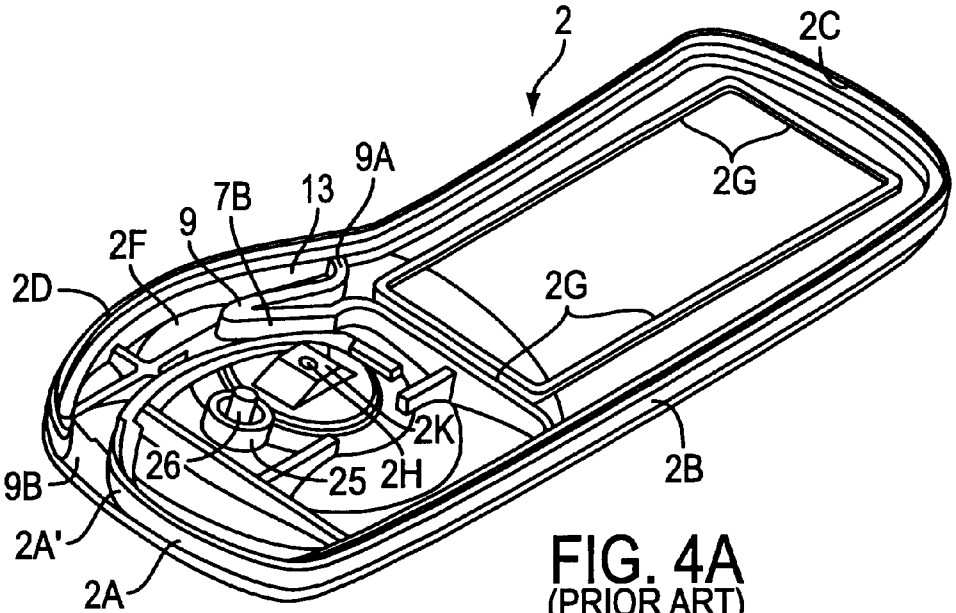
FIG. 4A (PRIOR ART)
FIG. 4A shows a view of the interior of the upper housing of the EAS tag of FIG. 1.
Figure 4B:
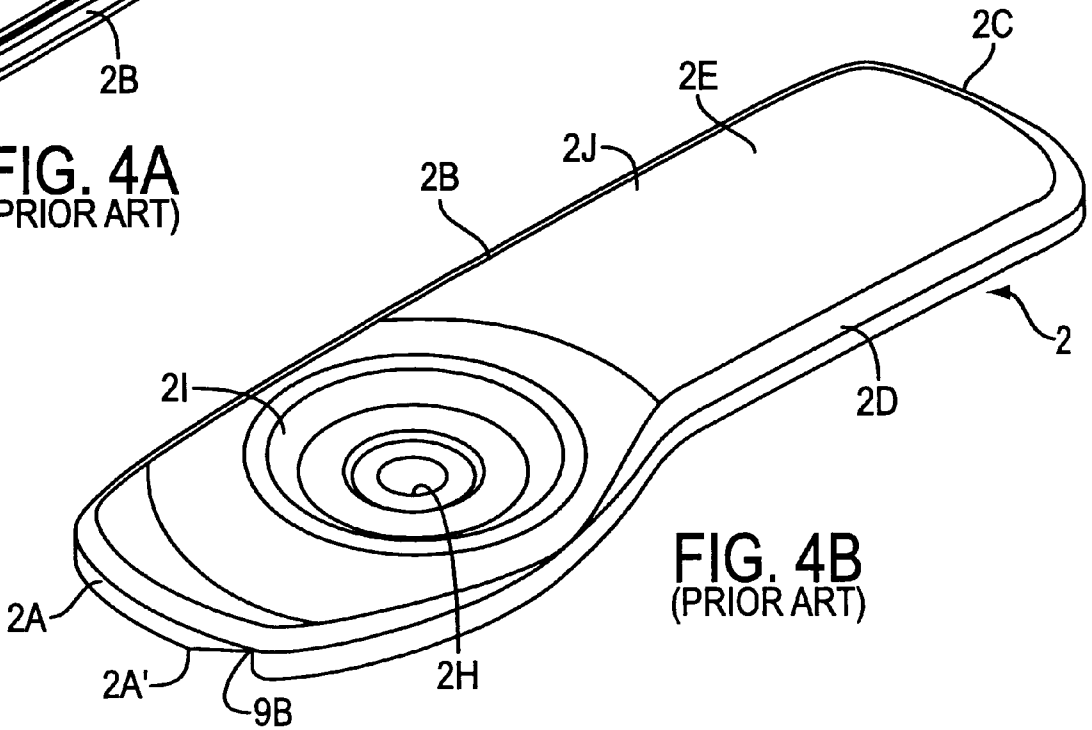
FIG. 4B (PRIOR ART)
FIG. 4B shows a view of the exterior of the upper housing of the EAS tag of FIG. 1.
Figure 5:
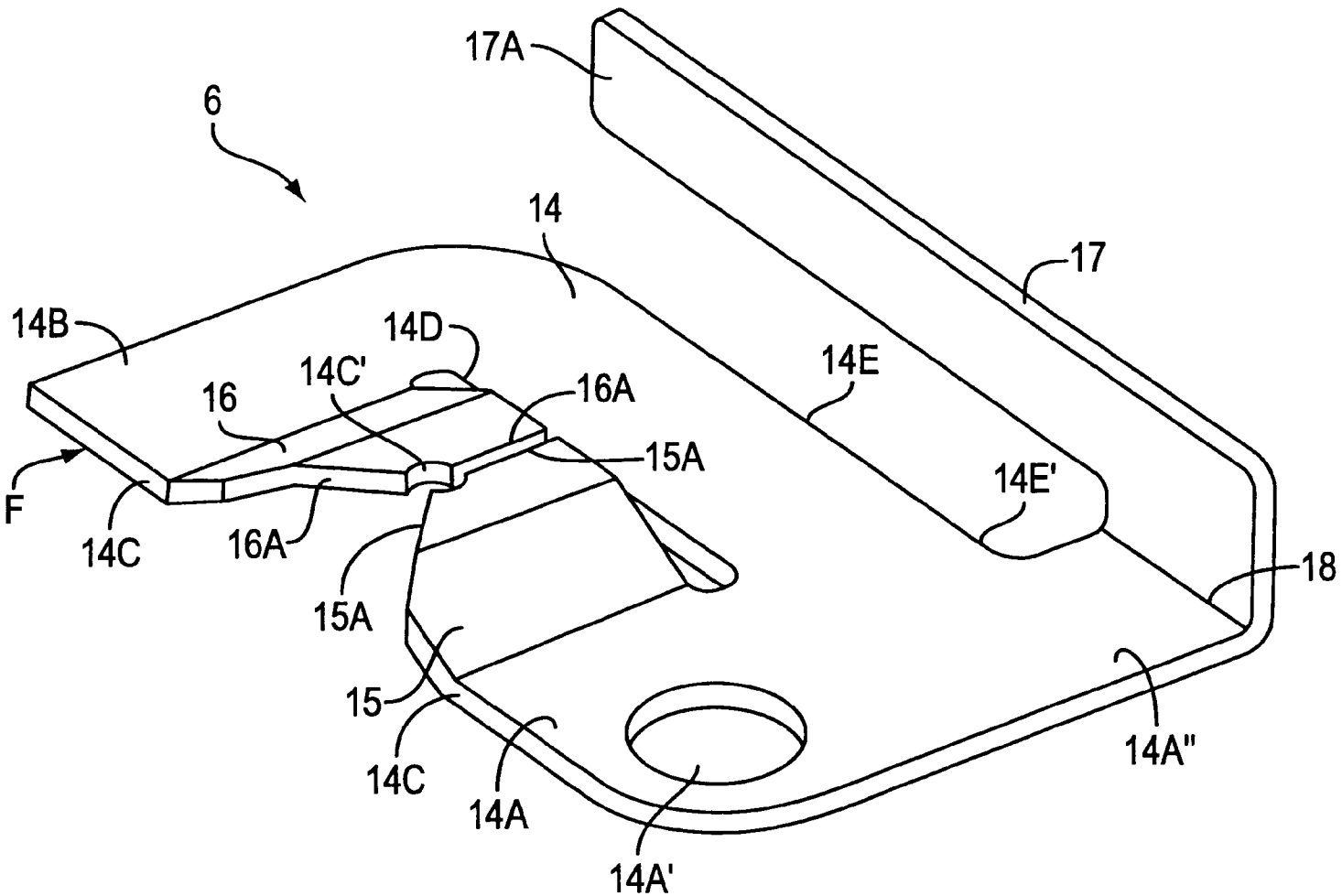
FIG. 5 (PRIOR ART)
FIG. 5 illustrates an exploded view of the spring clamp used in the EAS tag of FIG. 1.

In order to sense the tag 1 and, therefore, detect the presence of the tag and the attached article 51, the inner surfaces 2F and 3F of the walls 2E and 3E of the housings 2 and 3 are provided with frame members 2G and 3G which together define an interior cavity 1C for receiving an EAS sensor 5 (see, FIGS. 2, 3 and 4A). The EAS sensor 5 generates detectable signals and can be an acoustically resonant magnetic sensor as disclosed in U.S. Pat. Nos. 4,510,489 and 4,510,490. Possible other magnetic EAS sensors usable for the sensor 5 might be those disclosed in U.S. Pat. Nos. 4,686,516 and 4,797,658 and possible RF EAS sensors might be those disclosed in U.S. Pat. Nos. 4,429,302 and 4,356,477.

As above-noted, the article 51 is joined to the tag body 1A by the tack assembly 4. This is accomplished by inserting the tack body 4B into an opening 2H in the wall 2E of the upper housing 2. When the tack body 4B is fully inserted, the pointed end 4D of the tack is received in an upstanding cavity or collar 3H extending from the inner surface 3F of the lower housing wall 3E. The tack head 4A, in turn, seats in a recessed area 21 in the upper surface 2J of the wall 2E. The article 51 is thus held between the tack head 4A and the latter wall.

Member 6 to be discussed in greater detail below is provided within the tag body 1A for releasably preventing the tack body from being withdrawn from the tag body. The tack assembly 4B and the article 51 thus become releasably locked to the EAS tag by the member 6.

The EAS tag 1 is further adapted so that access to the member 6 for releasing same is made difficult for other than authorized personnel. To this end, the tag body 1A is configured so that access to the member 6 is through an arcuate channel 7 (see FIGS. 1, 3, 4A, 4B, 6A and 6B) defined by one or more inner walls and by parts of the side walls and upper and lower walls of the tag body 1A. With this configuration, a special arcuate probe 8 is needed to reach and release the member 6 and, thus, detach the tack assembly 4 and the article from the tag body 1A.

As shown, the arcuate channel 7 is defined by a curved inner wall 7A. This wall extends upward from the inner surface 3F of the bottom housing 3 to abut the inner surface 2F of the upper housing 2. The wall 7A is further spaced from the side wall 3D of the bottom housing 3 and its outward end 7A' terminates at an inward curved part 3A' of the side wall 3A. The inward curved part 3A' of the wall 3A results in a space or slot 9A between the side walls 3A and 3D of the lower housing 3.

The slot 9A cooperates with a similar slot 9B between the sides wall 2A and 2D of the upper housing 2 to define a second opening 9 for providing entry or access into the outward end 7' of the channel 7. At this entry point, the side wall 2A also curves inwardly at a part 2A', the latter part 2A' mating with the curved side wall part 3A' of the side wall 3 of the lower housing 3.

The channel 7 is further defined by a second curved wall 7B (see, FIGS. 4A and 7) extending downwardly from the inner surface 2F of the upper housing 2. The wall 7B is situated outward of the inner end 7A" of the curved wall 7A and extends beyond this end to the frame member 2G.

Figure 6B:
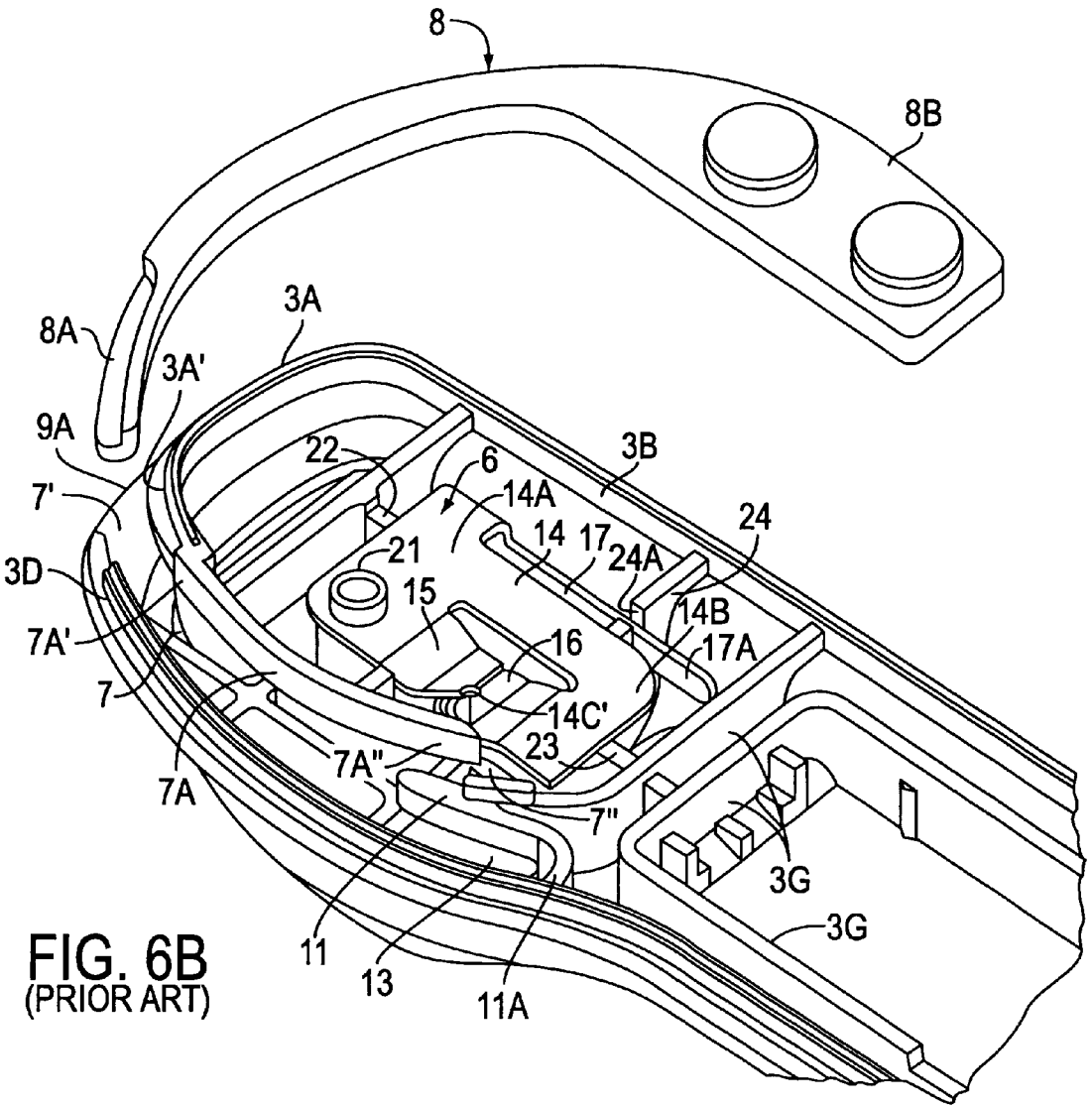
FIG. 6B (PRIOR ART)
Figure 7:
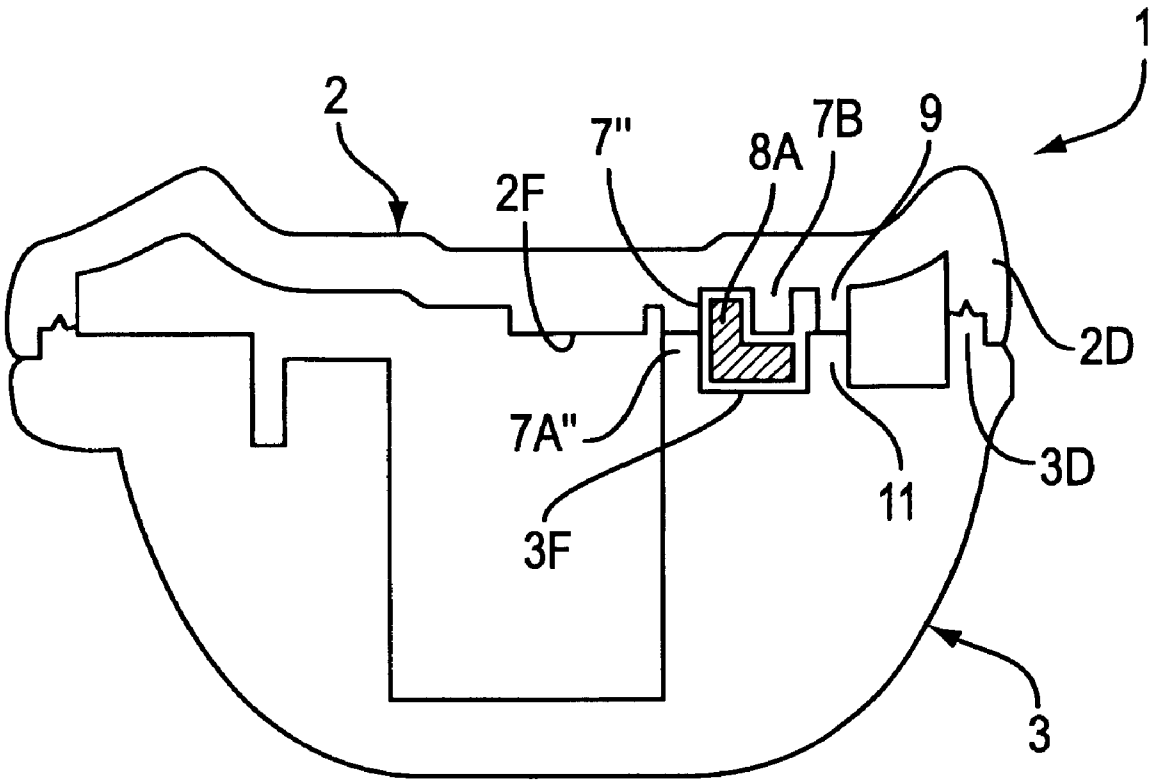
FIG. 7 (PRIOR ART)
FIG. 7 is a cross section of the EAS tag of FIG. 1 taken along the line B—B in FIG. 1 with the probe inserted in the arcuate channel in the tag.

The presence of the wall 7B changes or alters the configuration of the channel 7 at its inner end 7" which end lies adjacent the member 6 (see, FIG. 6B). This change or alteration in configuration defines a keyway for the channel 7 which must be accommodated by the probe 8 to pass through the channel and gain access to the member 6.

As illustrated, the wall 7B changes the channel cross section from substantially rectangular to substantially L-shaped. This is illustrated in the cross section of FIG. 7 which has been taken along the line B—B in FIG. 1 so that the cross section of the channel end 7" is made visible.

FIGS. 6A and 6B are enlarged views of the section of the lower housing 3 containing the member 6 and the arcuate channel 7. In FIG. 6A, the arcuate probe 8 is shown as received in and guided by the channel 7 to the member 6 for the purpose of releasing same. As can be seen, the forward end 8A of the probe 8 is recessed so as to be L-shaped and, thus, fit within the L-shaped keyway defined by inner end 7" of the channel. In FIG. 6B, the probe 8 is shown as withdrawn from the channel.

Adjacent the inner end 7" of the channel 7, the lower and upper housings 2 and 3 are provided with further curved walls 9 and 11 which terminate in wall sections 9A and 11A abutting the end walls 2D and 3D. The walls 9 and 11 are outward of the channel 7 and, with the end walls 2D and 3D, define a trap area 13, which prevents access to the member 6. This area provides a safety measure for blocking unauthorized objects introduced into the channel 7 of the tag body 1A in an attempt reach the member 6.

As above-noted, the member 6 is adapted to releasably prevent the tack body 4B from being withdrawn from the tag body 1A. More particularly, in further accord with the invention, the member 6 is specifically adapted to accommodate release of the tack body 4B via the arcuate probe 8 moving in the arcuate channel 7. The member 6 is shown in detail in FIGS. 6A and 6B and in an exploded view in FIG. 5.

As shown, the member 6 is in the form of a spring clamp having a clamp body 14 and jaws 15 and 16. The clamp body includes a mounting part 14A extending laterally of the jaw 15 and a release part 14B extending laterally of the jaw 16. The mounting part 14A includes a mounting aperture 14A'.

Each of the jaws 15, 16 extends outwardly of the plane of the clamp body 14 and then inwardly toward the other jaw. The jaws 15, 16, furthermore, terminate in facing edges 15A and 16A. These edges extend from a common edge 14C of the clamp body 14 inwardly toward each other, then curve outwardly away from each other to define an aperture 14C' (typically, circular or elliptical) for receiving the tack body 4B. The edges 15A and 16A then continue in aligned fashion and end in an elongated, lateral slot 14D in the clamp body 14. The latter slot lies inward of a further clamp body edge 14E, which opposes the clamp body edge 14C.

A further laterally extending elongated spring sleeve or arm 17 is attached by a joint area 18 to the side 14E' of the edge 14E bordering the mounting part 14A. The sleeve 17 extends along the length of the edge 14E and is also out of the plane of the clamp body.

For mounting and supporting the spring clamp 14, the lower housing 3 of the tag body 1A includes a hollow circular mount 21 with a lip 21A and support walls 22, 23 and 24 (see, FIGS. 2, 3, 6A and 6B). The clamp is mounted, via the aperture 14A' of the mounting part 14, on the mount 21 with the area of mounting part adjoining the aperture 14A' supported on the lip 21A. A circular wall 25 of the upper housing 3 and a central cylindrical stud 26 of this housing (see, FIGS. 2 and 4A) maintain the mounting part 14A in its mounted position, while allowing the mounting part to be rotated. The spring clamp 14 is thus able to pivot about the mounting part as will be described more fully below.

The back end 14A" of the mounting part 14A and the lateral part of the clamp connecting the mounting part 14A and the release part 14B are supported on the support walls 22 and 24, while the release part is carried by the wall 23. The spring sleeve 17 rests with one end 17A in a slot 24A in the support wall 24.

When the pointed end 4D of the tack body 4B is introduced in the downward direction through the opening 2H in the upper housing 2, the part 2K of the upper housing, which part is shaped to fit within the hollow of the spring clamp body 14 above the jaws 15, 16 and carries the opening 2H, directs the tack body to the aperture 14C' defined by the facing edges 15A, 16A of the jaws. This causes the jaws to spread or open and allow the tack body 4B to pass through the jaws.

When the downward tack travel is stopped at a desired slot 4C, i.e., a slot which provides a tight fit of the tack head 4A and article 51 to the wall 2E of upper housing 2, the jaws 15, 16 retract and clutch the tack body 4B. In this position, the jaws 15, 16 prevent upward movement of the tack 4. The tack 4 and article 51 thus become locked to the tag body 1A.

In order to release the tack 4 from the tag body 1A, the arcuate probe 8 is now introduced into the opening of the tag body 1A via rotation of the probe about its rearward end 8B. This causes the probe to be moved in and guided by the channel 7 until the L-shaped forward end 8A of the probe reaches and passes into the L-shaped inner end 7" of the channel 7. This brings the probe end 8A to the part of the common edge 14C bordering the release part 14B of the clamp body 14.

Continued rotational movement of the probe 8 then causes a force on the release part 14B. This force, in turn, causes the clamp body 14 to rotate about the support area 14A on the mount 21. The jaws 15, 16 are thus enabled to spread apart or open due to the force of the tack body 4B, which is held stationary by the collar 3H, acting on the walls of the aperture 14C'. The aperture 14C' thus expands, releasing the tack body 4B from the grip or clutch of the jaws. The tack 4 can now be moved in the upward direction past the jaws, via an upward force on the tack head 4A, thereby withdrawing and separating the tack body 4B from the tag body 1A and the article 51 from the tag 1.

During rotation of the spring clamp body 14 as a result of the in-plane force exerted by the probe 8, the spring arm 17 at the joint 18 is compressed. After the tack 4 is separated from the tag body 1A, the probe 8 is rotated in the reverse direction. This reverse rotation disengages the probe from the release part 14A of the spring clamp 14 as the probe 8 is withdrawn from the channel 7. The force on the spring clamp 14 is thus removed and the spring arm 17 expands. This causes the spring clamp 14 to rotate in the opposite direction about the support area 14A. The spring clamp 14 is thereby brought back to its original position awaiting reentry of the tack body 4B for again attaching an article to the tag 1.

Detaching assemblies which incorporate the arcuate detaching probe 8, and can be used to rotate the probe as above-described to detach the tack 4 from the tag 1 are fully illustrated in the '419 patent, which has been incorporated herein by reference. It should be noted that the spring clamp 14 of the tag 1 can be constructed of spring sheet metal. The probe 8, in turn, can be constructed of hardened tool steel.

As described above, EAS tag 1 is adapted so that access to member 6 for releasing tack assembly 4 is made difficult for other than authorized personnel. However, defeats have occurred by using a bent piece of common electrical "fish tape" to unlock the mechanical clutch. Fish tape is a relatively rigid but bendable steel wire used to pull electrical wires through conduit.

Figure 8:
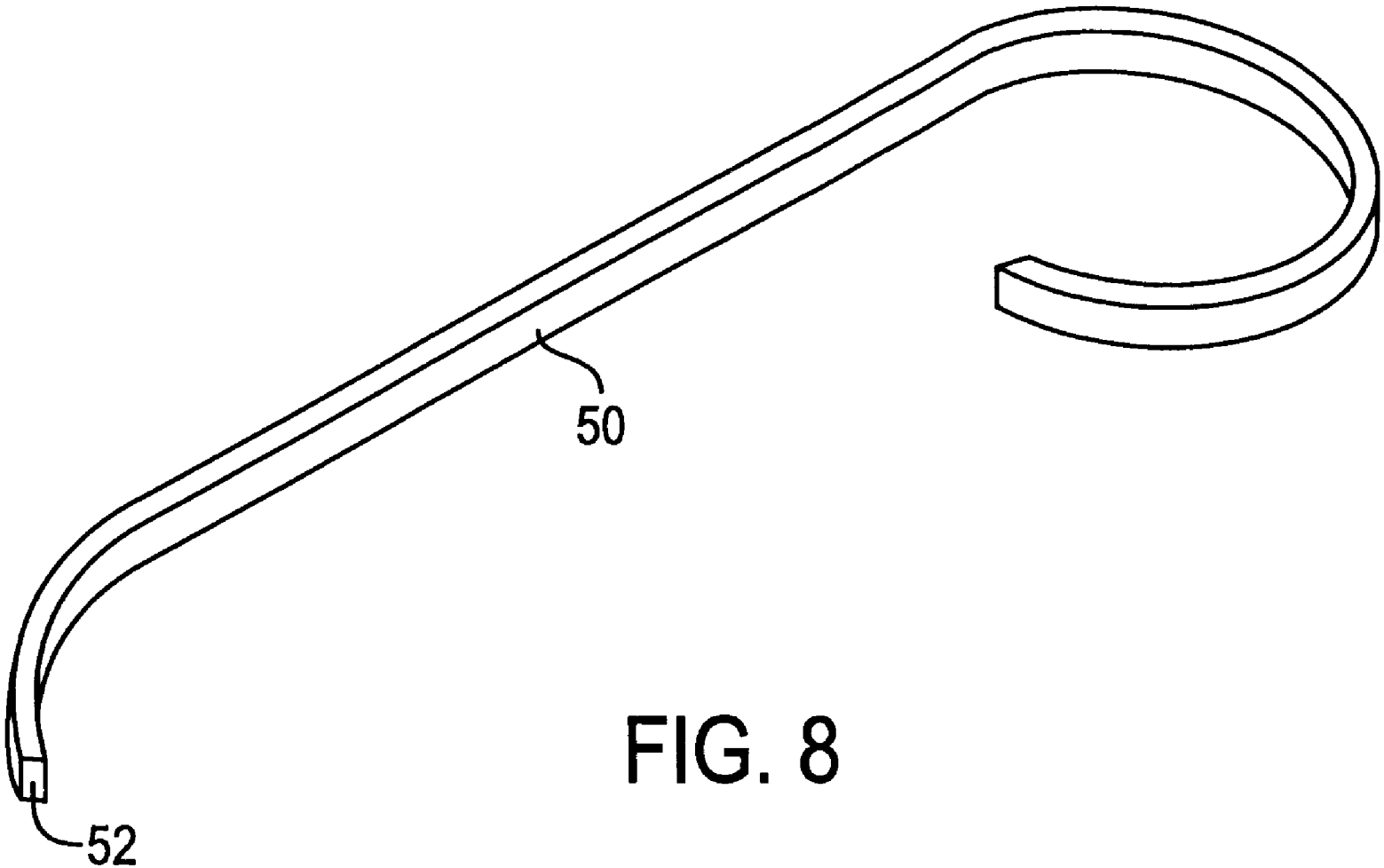
FIG. 8 is a perspective view of formed fish tape use to defeat the EAS tag of FIG. 1.

FIG. 8 illustrates a segment of fish tape 50 formed to resemble arcuate probe 8. The fish tape 50 is available in a variety of sizes, and has a rectangular cross-section 52, which simulates the vertical member of the "L" formed at probe end 8A, as seen in FIG. 6B. The formed fish tape 50 is inserted into arcuate channel 7 until it can be manipulated into and against member 6, which then can be rotated to release tack assembly 4 as described above. The formed fish tape 50 is strong enough to hold its form when pushed into arcuate channel 7 to engage member 6 to release tack 4. The solution to prevent such defeats, as fully described below, is to modify the EAS tag 1 to make it very difficult to insert a fish tape or other rigid and/or semi-flexible wire far enough into arcuate channel 7 to reach member 6 and release tack assembly 4.

Figure 9:
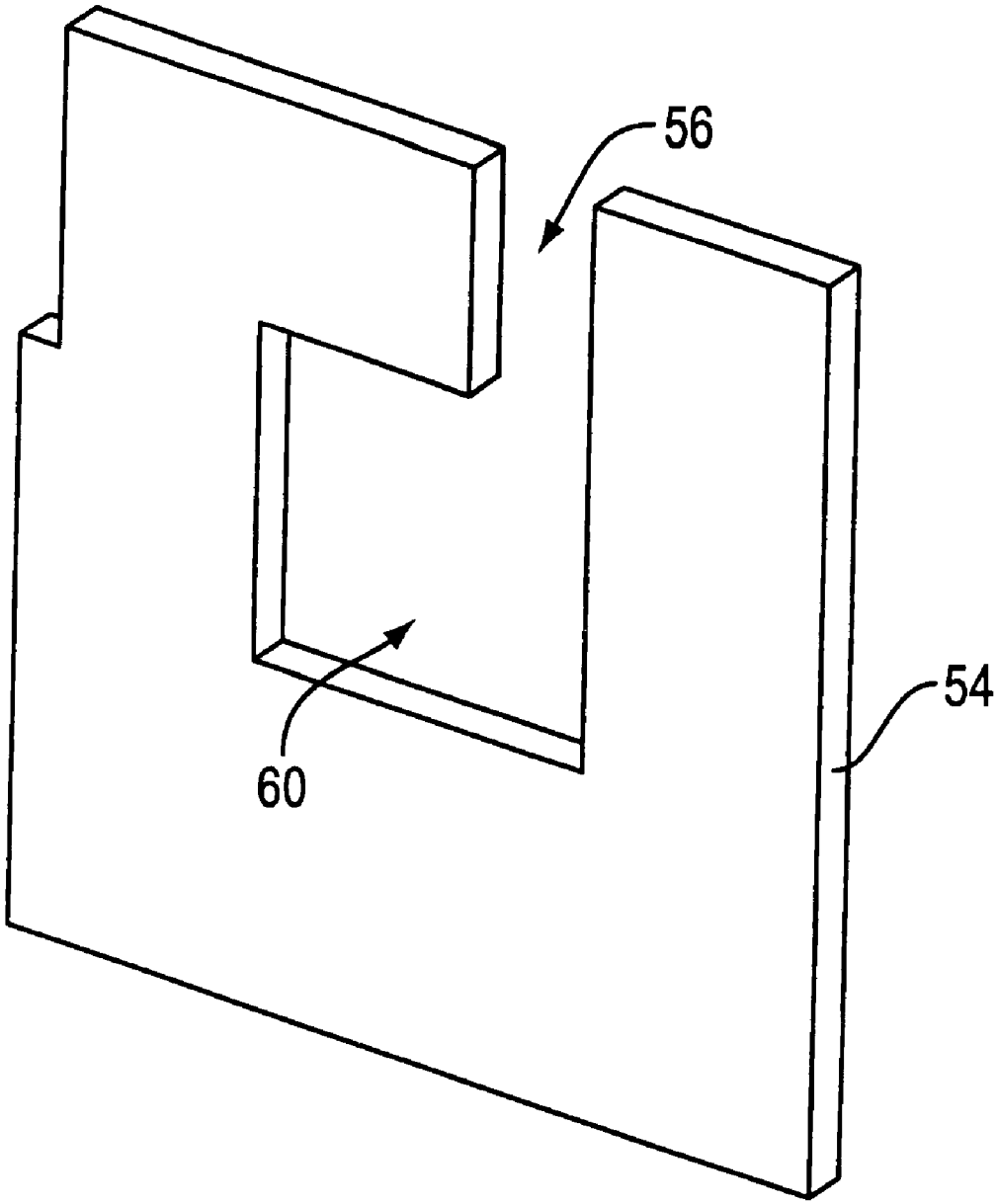
FIG. 9 is a perspective view of the abutment of the present invention.
Figure 10:
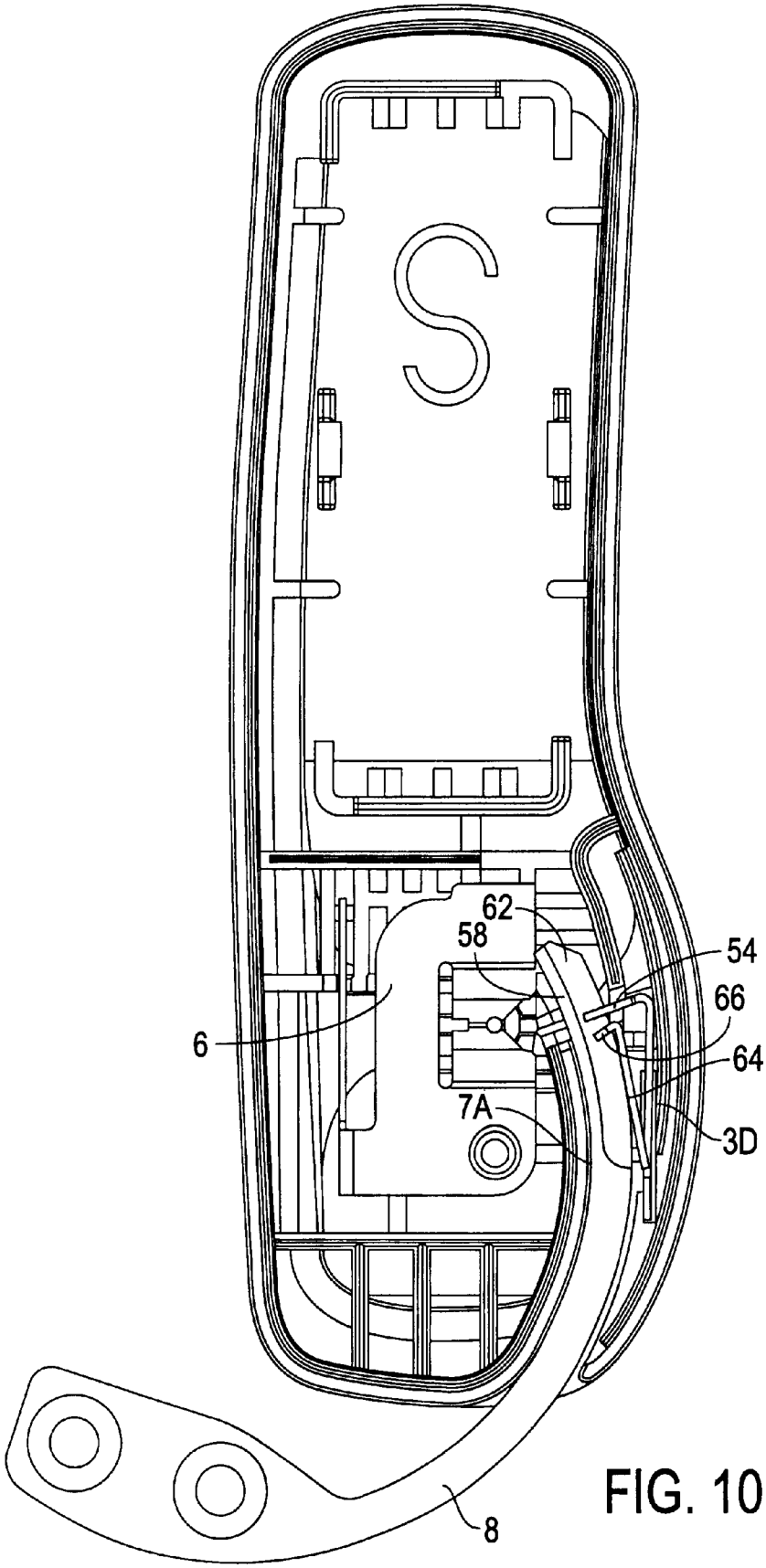
FIG. 10 is a top plan view of the lower section of an EAS tag of FIG. 1, shown with the arcuate probe and including the present invention.

Referring to FIGS. 9 and 10, a rigid abutment 54, which can be hardened steel, is placed in arcuate channel 7, as shown in FIG. 10. Abutment 54 is located at the far end of the channel 7, but before channel 7 reaches member 6. Abutment 54 thus isolates arcuate channel 7 from a chamber surrounding member 6. The abutment 54 has a vertical opening or slot 56 that extends from the top of arcuate channel 7 along the inside wall 7A, and is just wide and long enough to allow the vertical member 58 of the "L" formed at probe end 8A closely through, but nothing wider. For example, for a vertical member 58 width of about 0.035 inches, the width of the vertical slot 56 should be about 0.040 inches. The abutment 54 is of a sufficient thickness, such as 0.015" for hardened steel, but may be a different thickness depending upon the hardness of the material used. The abutment 54 is firmly mounted in the side walls of the arcuate channel 7, and preferable in a perpendicular orientation. Formed fish tape 50 thicker than about 0.040", for the present example, cannot get through the abutment 54 to member 6. The abutment 54 also has a horizontal opening or slot 60 for the horizontal member 62 of the arcuate probe 8. Horizontal slot 60 must be wider than the vertical slot 56 to allow for differences between detachers and EAS tags 1, and a user occasionally not holding the EAS tag firmly in the detacher. Detachers are fully disclosed in the '419 patent, and in U.S. Pat. No. 5,535,606. By not holding a tag 1 down firmly in the detacher, the tag 1 may not release the tack 4 and detaching must be repeated; the slight vertical misalignment of the arcuate probe 8 to the tag 1 causes no damage. But if the abutment 54 is in place and had a narrow horizontal slot 60, a slight vertical misalignment could cause the arcuate probe 8 to miss the horizontal slot 60 and engage the solid part of the abutment 54 and potentially damage the tag 1 and/or the detacher. Alignment of the vertical member 58 and the vertical slot 56 is not of concern because the alignment is accurately controlled by the tight horizontal nesting of the tag 1 in the detacher.

Figure 11:
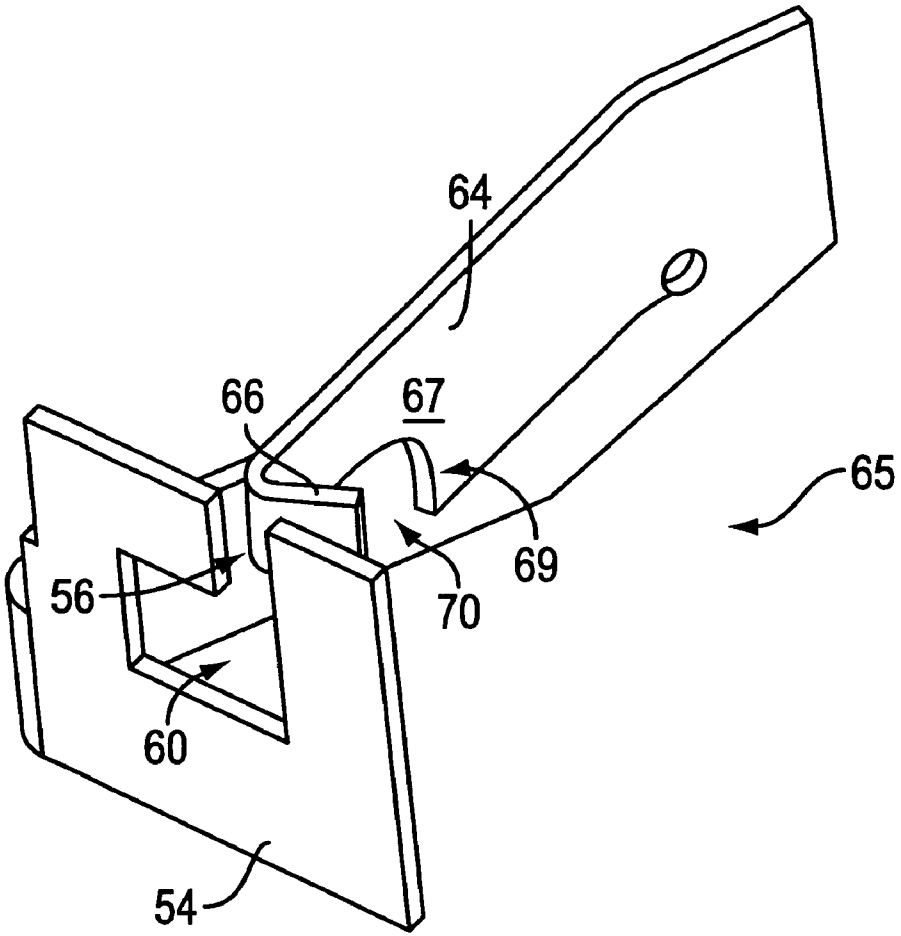
FIG. 11 is perspective view of the abutment and spring gate of the present invention.
Figure 12:
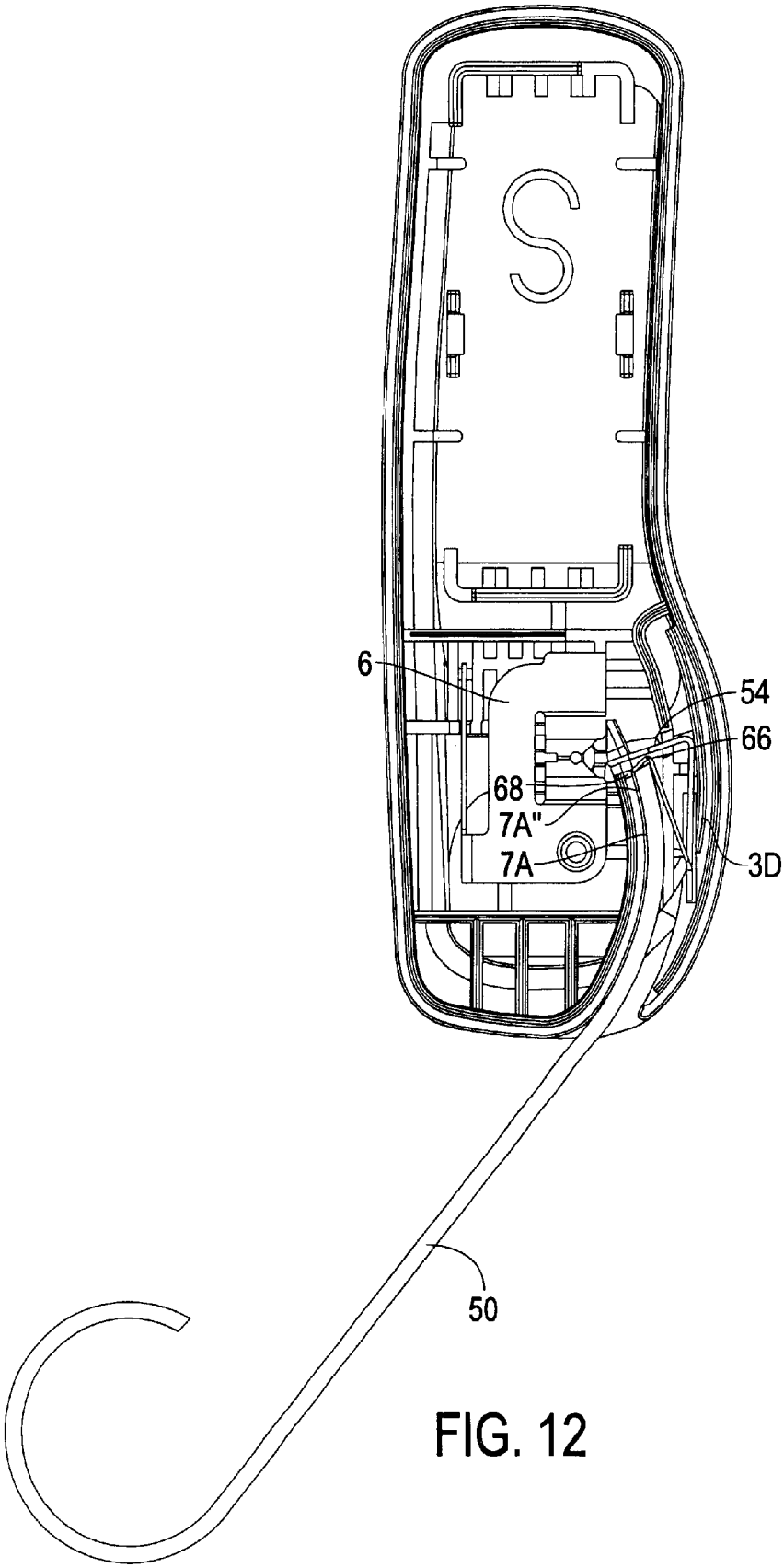
FIG. 12 is a top plan view of the lower section of an EAS tag of FIG. 1, shown with a formed fish tape and including the present invention.

Referring to FIG. 11, a second aspect of the invention uses a spring gate 65 to impede thinner formed fish tape 50 from entering the chamber surrounding member 6. To accomplish this, a leaf spring 64 is mounted in the outside wall 3D of the arcuate channel 7, as shown in FIGS. 10 and 12. The leaf spring 64 is slightly shorter than the height of channel 7 so it can move unimpeded across the channel. The preferably thin (~0.015" when made of hardened steel) leaf spring 64 extends from about half way into channel 7 across the channel diagonally ending at a point almost touching the abutment 54, and touching the inside channel wall 7A near the inner end 7A". The abutment end of the leaf spring 64 has an extension bent at approximately 90 degrees to the leaf spring body 67 forming a catch 66. The bend, which can be about 0.062" for hardened steel, is bent towards the inside wall 7A of channel 7. The catch 66 is biased by the leaf spring 64 into a groove 68 formed in the inside channel wall 7A. The vertical height of the catch 66 is reduced from that of the leaf spring body 67 to the height of the vertical slot 56 in the abutment 54 and is aligned with it. The leaf spring 64 can be an integral part of the abutment 54, which is typically desirable for manufacturing, or can be made separately.

Referring to FIG. 12, when a thin formed fish tape 50 travels the arcuate channel 7 toward the vertical slot 56 in abutment 54, it will engage the leaf spring 64 obliquely and push against the leaf spring bias, placing the catch 66 in front of the vertical slot 56. The end of the formed fish tape 50 is thus stopped from nearing member 6 by the catch 66. Formed fish tape 50 of both thick and thin cross-sectional widths are caught in the same manner.

Referring again to FIG. 10, when the arcuate probe 8 travels the arcuate channel 7 towards the vertical slot 56, the horizontal leg 62 engages the leaf spring 64 below catch 66, near 69 shown in FIG. 11, and pushes it against its bias toward the outside wall 3D of channel 7. Because of the width of the horizontal member 62, the leaf spring 64 moves sufficiently to clear the vertical slot 56 allowing arcuate probe 8 to enter the chamber surrounding member 6, engaging member 6 and releasing the tack assembly 4. Thus, attempts to engage member 6 with formed fish tape 50 are thwarted, but an arcuate probe 8 will be able to fully traverse channel 7 to engage member 6 and release tack 4.

To help prevent working the catch 66 to the side of the vertical slot 56 by twisting and pushing of the formed fish tape 50, the available surface area of leaf spring 64 to push against its bias can be reduced. Thus, as shown in FIG. 11, the lower portion 70 of the leaf spring 64 is minimized while still allowing the horizontal member 62 of probe 8 to "open the gate", as shown in FIG. 10. If fish tape 50 is worked below catch 66 and through horizontal slot 60, the end 52 of fish tape 50 will be positioned below member 6 such that member 6 cannot be engaged and tack assembly 4 will not be released.

Figure 13:
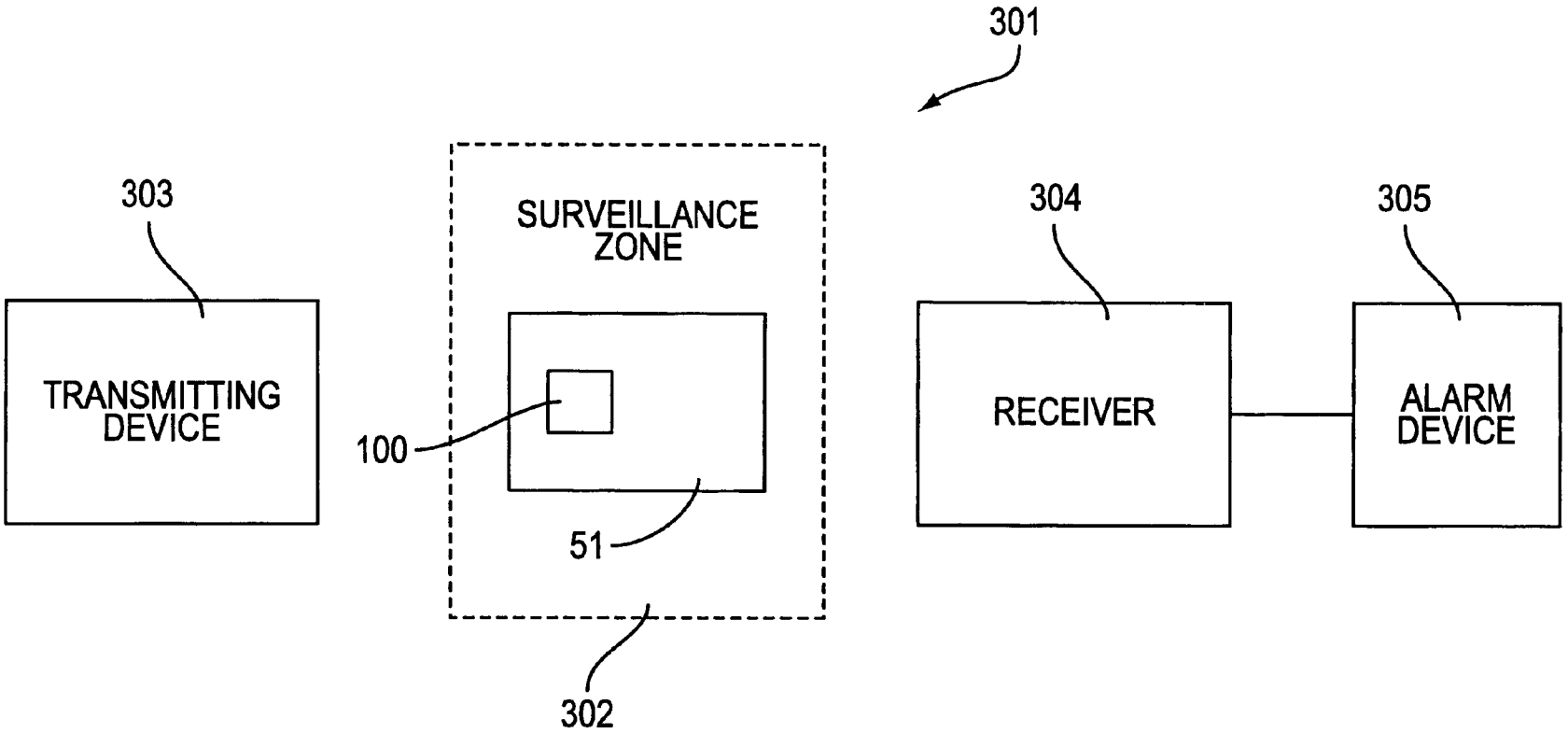
FIG. 13 is a block diagram of an electronic article surveillance system for use in conjunction with the EAS tag of the present invention.

FIG. 13 shows an EAS system 301 used to detect or sense EAS tag 100 when passing through a surveillance zone 302. EAS tag 100 is an EAS tag 1, described hereinabove, modified to include the present invention. An interrogation signal is transmitted into the zone 302 via a transmitting device 303. A signal resulting from interaction of the sensor 5 in the tag 100 with the transmitted signal is received at a receiver 304, which communicates with a detection and alarm device 305. The latter detects the received signal and generates an alarm indicating the presence of the tag 100 and the article 51 in the surveillance zone 302.

The particular configurations used for the devices 303, 304 and 305 in the system 301 will depend on the particular nature of the sensor. For the types of sensors disclosed in the above-mentioned patents, devices of the types also disclosed in these patents can be used.

It is understood that the above-described arrangements are merely illustrative of the many possible specific embodiments, which represent applications of the present invention. Numerous and varied other arrangements can be readily devised in accordance with the principles, of the present invention without departing from the spirit and scope of the invention.

What is claimed is:

1. An EAS tag having a tag body; means for attaching said tag body to an article, said attaching means having a part which is received in said tag body; means within said tag body for releasably preventing said part of said attaching means from being withdrawn from said tag body; means within said tag body defining an arcuate channel leading from the exterior of said tag body to said preventing means, said arcuate channel being adapted to receive and guide an arcuate probe to said preventing means for releasing said preventing means from preventing said part of said attaching means from being withdrawn from said tag body; and a detectable EAS sensor, the improvement characterized by;

abutment means within said arcuate channel for preventing the insertion of a relatively rigid wire into said arcuate channel far enough to release said preventing means, the rigid wire formed substantially in the arcuate shape of said arcuate probe.

2. An EAS tag in accordance with claim 1 wherein said abutment means is a substantially planar rigid member with a vertical and horizontal opening forming a substantially "L" shaped opening to receive a corresponding "L" shape of said arcuate probe, said rigid member being positionable substantially perpendicular in said arcuate channel, said vertical opening sized and positioned to allow a vertical member of said "L" shape of said arcuate probe to closely pass through when said arcuate probe is inserted into said arcuate channel to release said preventing means.

3. An EAS tag in accordance with claim 2 wherein said abutment means includes a spring gate assembly for preventing insertion of the rigid wire, said spring gate assembly comprising a catching means for catching the rigid wire and preventing further insertion of the wire into said arcuate channel, said catching means disposed on one end of a spring member, said spring member attachable to said tag body and biasing said catching means against a wall of said arcuate channel and in front of said vertical opening in said rigid member, a horizontal member of said "L" shaped arcuate probe pushing against the bias of said spring member upon insertion of said arcuate probe in said arcuate channel wherein said means for catching is pushed away from said vertical opening in said rigid member allowing said arcuate probe to closely pass therethrough.

4. An EAS tag in accordance with claim 3 wherein said catching means is a bent portion of the end of said spring member.

5. A rigid planar abutment for use in preventing insertion of a relatively rigid wire formed in the shape of an arcuate probe adapted for insertion into an arcuate channel of an EAS tag for releasing an attaching assembly, the rigid planar abutment positionable in the arcuate channel and comprising: a substantially planar rigid member having a vertical and horizontal opening that forms an "L" shape corresponding to an "L" shape of the arcuate probe, wherein the vertical member of the "L" shaped arcuate probe closely passes through the vertical opening of the "L" shaped opening in said rigid member.

6. The abutment of claim 5 further including a spring gate assembly for preventing insertion of the rigid wire, said spring gate assembly comprising: a catching means for catching the rigid wire and preventing further insertion of the wire into said arcuate channel, said catching means disposed on one end of a spring member, said spring member attachable to the EAS tag body and biasing said catching means into a recess in a wall of said arcuate channel and in front of said vertical opening in said rigid member, a horizontal member of said "L" shaped arcuate probe pushing against the bias of said spring member upon insertion of said arcuate probe in said arcuate channel wherein said means for catching is pushed away from said vertical opening in said rigid member allowing said arcuate probe to closely pass therethrough.

7. A rigid planar abutment for use in preventing insertion of a relatively rigid wire formed in the shape of a probe adapted for insertion into a channel of an EAS tag for releasing an attaching assembly, the rigid planar abutment positionable in the channel and comprising: a substantially planar rigid member having a vertical and horizontal opening that forms an "L" shape corresponding to an "L" shape of the probe, wherein the vertical member of the "L" shaped probe closely passes through the vertical opening of the "L" shaped opening in said rigid member.

8. The abutment of claim 7 further including a spring gate assembly for preventing insertion of the rigid wire, said spring gate assembly comprising: a catching means for catching the rigid wire and preventing further insertion of the wire into said channel, said catching means disposed on one end of a spring member, said spring member attachable to the EAS tag body and biasing said catching means into a recess in a wall of said channel and in front of said vertical opening in said rigid member, a horizontal member of said "L" shaped probe pushing against the bias of said spring member upon insertion of said probe in said channel wherein said means for catching is pushed away from said vertical opening in said rigid member allowing said probe to closely pass therethrough.

* * * * *